US009290713B2

(12) United States Patent
Souza et al.

(10) Patent No.: US 9,290,713 B2
(45) **Date of Patent: *Mar. 22, 2016**

(54) BASE OIL BLEND UPGRADING PROCESS WITH A GROUP II BASE OIL TO YIELD IMPROVED MINI-ROTARY VISCOMETER RESULTS

(71) Applicant: Chevron U.S.A. Inc., San Ramon, CA (US)

(72) Inventors: Alex Beringuy Souza, Rio de Janiero (BR); Gerson Vieira Baeta Neves, Rio de Janeiro (BR); Luiz Fernando Feijo Lemos, Rio de Janeiro (BR); Wanderley Carreira Souza, Jr., Rio de Janeiro (BR); Matthew Hussain Ansari, San Ramon, CA (US); Rebecca Elizabeth Brafman, Concord, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 143 days.

This patent is subject to a terminal disclaimer.

(21) Appl. No.: 13/837,845

(22) Filed: Mar. 15, 2013

(65) Prior Publication Data

US 2014/0274828 A1 Sep. 18, 2014

(51) Int. Cl.
*C10M 101/02* (2006.01)

(52) U.S. Cl.
CPC ..... *C10M 101/025* (2013.01); *C10M 101/02* (2013.01); *C10M 2203/1006* (2013.01); *C10M 2203/1025* (2013.01); *C10M 2203/1065* (2013.01); *C10N 2220/00* (2013.01); *C10N 2220/02* (2013.01)

(58) Field of Classification Search
CPC ..... C10M 10/02; C10M 101/025; C10M 2203/10; C10M 2203/1006; C10M 2203/102; C10M 2203/1025; C10M 2203/106; C10M 2203/1065; C10M 2230/00; C10M 2230/02
See application file for complete search history.

(56) References Cited

U.S. PATENT DOCUMENTS

| | | | | |
|---|---|---|---|---|
| 7,520,976 | B2 | 4/2009 | Miller et al. | |
| 7,875,458 | B2 | 1/2011 | Eagan et al. | |
| 7,926,453 | B2 | 4/2011 | Roby et al. | |
| 7,956,018 | B2 | 6/2011 | McGeehan | |
| 7,991,104 | B1 | 8/2011 | Dahan | |
| 2010/0077842 | A1 * | 4/2010 | Rosenbaum et al. | 73/54.01 |
| 2012/0132166 | A1 | 5/2012 | Andoh et al. | |

OTHER PUBLICATIONS

Hipeaux, et al., Physico-chemical characterization of base stocks and thermal analysis by differential scanning calorimetry and thermomicroscopy at low temperature, Themochimica Acta 348 (2000) 147-159.

* cited by examiner

*Primary Examiner* — Taiwo Oladapo
(74) *Attorney, Agent, or Firm* — Melissa M. Hayworth; Susan M. Abernathy; Mary R. Bram

(57) ABSTRACT

A process for improving MRV performance and decreasing wax crystallization in a lubricating oil, comprising: replacing between about 5 to 60 wt % of a base oil or base oil blend with between about 5 to 60 wt % of a Group II base oil. A resultant multigrade engine oil affords a Mini-Rotary Viscosity (MRV) at −30° C. of less than 60,000 mPa·s with no yield stress. The multigrade engine oil, comprising: (a) between about 10 to 30 wt % of a Group II base oil and (b) between about 40 to 60 wt % of a Group I paraffinic base oil characterized by: (i) a VI from about 98 to 104, and (ii) a kinematic viscosity from about 4.5 to 5.5 cSt at 100° C., and (c) an additive package.

15 Claims, No Drawings

BASE OIL BLEND UPGRADING PROCESS WITH A GROUP II BASE OIL TO YIELD IMPROVED MINI-ROTARY VISCOMETER RESULTS

FIELD OF THE INVENTION

The present invention relates to a multigrade engine oils formulated to meet the specifications for SAE viscosity grade 0W-XX, 5W-XX, or 10W-XX engine oil, wherein XX represents the integer 20, 30, or 40. Formulations meeting the specifications for SAE viscosity grade 10W-30 have been successfully prepared using the present invention. This requires that the MRV of the formulation must have a result of less than 60,000 cP at −30° C. with no yield stress. The present invention further relates to an intuitive process for improving MRV performance by decreasing wax crystallization with the replacement of a portion of a base oil or base oil blend with a suitable quantity of a Group II base oil, without the need for additional pour point depressant.

BACKGROUND OF THE INVENTION

The dewaxing processes used to manufacture lubricating oil basestocks can result breakdowns or inefficiencies in the processes affording a quantity of wax beyond an acceptable basestock manufacture specification. The presence of contamination wax or excessive wax content can occur as a result of leakage of wax through rips or tears in the wax filter cloth used in solvent dewaxing processes, overloading of the solvent dewaxing processes, basestock channeling through the catalytic beds used in catalytic dewaxing processes, overloading of the catalytic dewaxing process, poor catalyst activity or selectivity or because the crude oil or feedstock to the process is significantly different than expected, resulting in unsuitable dewaxing process conditions.

Lubricating oil basestocks containing undesirable quantities of contamination wax or excessive wax can result in growth of wax crystals, which is typically a slow process and may only become visible upon visual inspection after several days or weeks. As a consequence, when fully formulated oils are produced using basestocks containing unidentified undesirable wax contamination may result in an entire batch of product failing to meet viscometric specifications. Furthermore, formulated lube oils have been found to fail key low temperature viscometric properties for the oil [e.g., the cold cranking simulator (CCS) viscosity or the mini-rotary viscometer (MRV)], despite passing the specification established for the oil with respect to cloud point and/or pour point.

Contamination wax or excessive wax can result in the failure of any formulated oil made from lubricating oil basestocks containing residual wax to function properly at low temperature. As such, residual wax contamination can afford a formulated oil with unsatisfactory low temperature viscometric properties. In this regard, contamination wax or excessive wax can result in a highly non-Newtonian increase in low temperature viscometrics in fully formulated oils resulting in high viscosities and/or poor pumpability at low temperatures. With regard to engine oils, hydraulic oils or transmission fluids, the increase in low temperature viscometrics or the reduction in or loss of filterability results in a failure of the oil to properly lubricate key componenets. Moreover, wax crystals can form a haze in the oil upon standing, which is undesirable for customers from a cosmetic perspective, as well.

Engine oils are finished crankcase lubricants intended for use in automobile engines and diesel engines and consist of two general components; a lubricating base oil and additives.

Lubricating base oil is the major constituent in these finished lubricants and contributes significantly to the properties of the engine oil. In general, a few lubricating base oils are used to manufacture a variety of engine oils by varying the mixtures of individual lubricating base oils and individual additives. The minimum specifications for the various viscosity grades of engine oils is established by SAE J300 standards as revised in January 2009.

Numerous governing organizations, including Original Equipment Manufacturers (OEM's), the American Petroleum Institute (API), Association des Consructeurs d' Automobiles (ACEA), the American Society of Testing and Materials (ASTM), International Lubricant Standardization and Approval Committee (ILSAC), and the Society of Automotive Engineers (SAE), among others, define the specifications for lubricating base oils and engine oils. Increasingly, the specifications for engine oils are calling for products with excellent low temperature properties, high oxidation stability, and low volatility. Currently, only a small fraction of the base oils manufactured today are able to meet these demanding specifications.

Accordingly, there is need for methods or processes for removing or reducing contamination wax or excessive wax with lubricating base oils or formulated lubricating oils, which have difficulty passing the stringent mini-rotary viscometer (MRV) viscosity specifications under SAE J300 as revised in January 2009.

SUMMARY OF THE INVENTION

In one embodiment, the present invention provides a process for improving MRV performance and decreasing wax crystallization in a lubricating oil, comprising: replacing between about 5 to 60 wt % of a base oil or base oil blend with between about 5 to 60 wt % of a second base oil comprising: a Group II base oil.

In another embodiment, the present invention provides a multigrade engine oil comprising: (a) a first base oil, comprising: at least about 55 wt % of the molecules have paraffinic functionality, at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; (b) a second base oil; and (c) an additive package. The multigrade engine oil comprises between about 30 to 50 wt % of the first base oil and about 10 to 30 wt % of the second base oil.

DETAILED DESCRIPTION OF THE INVENTION

In another embodiment, the present invention provides a process for improving MRV performance or decreasing wax crystallization in a lubricating oil, comprising: replacing between about 5 to 60 wt % of a base oil or base oil blend with between about 5 to 60 wt % of a second base oil comprising: a Group II base oil.

In some embodiments, the present invention provides a process for improving MRV performance and decreasing wax crystallization in a lubricating oil, comprising: replacing between about 5 to 60 wt % of a base oil or base oil blend with between about 5 to 60 wt % of a second base oil, wherein the second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.

In some embodiments, the present invention provides a process for improving MRV performance and decreasing wax crystallization in a lubricating oil, comprising: replacing between about 5 to 60 wt % of a base oil or base oil blend with between about 5 to 60 wt % of a second base oil, wherein the second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.

In some embodiments, the present invention provides a process for improving MRV performance or decreasing wax crystallization in a lubricating oil, comprising: replacing between about 5 to 60 wt % of a base oil or base oil blend with between about 5 to 60 wt % of a second base oil, wherein the second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.

In some embodiments, the present invention provides a process for improving MRV performance or decreasing wax crystallization in a lubricating oil, comprising: replacing between about 5 to 60 wt % of a base oil or base oil blend with between about 5 to 60 wt % of a second base oil, wherein the second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.

In some embodiments, the present invention provides a process for improving MRV performance and decreasing wax crystallization in a lubricating oil, further comprising:

(a) obtaining a first base oil comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and (b) blending the second base oil with the first base oil obtained in Step (a).

In some embodiments, the present invention provides a process for improving MRV performance and decreasing wax crystallization in a lubricating oil, wherein the first base oil is a Group I base oil.

In some embodiments, the present invention provides a process for improving MRV performance and decreasing wax crystallization in a lubricating oil with no additional pour point depressant.

In some embodiments, the present invention provides a process for improving MRV performance and decreasing wax crystallization in a lubricating oil, further comprising:

(a) obtaining a first base oil comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and (b) blending the second base oil with the first base oil obtained in Step (a), and wherein, the second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.

In some embodiments, the present invention provides a process for improving MRV performance and decreasing wax crystallization in a lubricating oil, further comprising:

(a) obtaining a first base oil comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and (b) blending the second base oil with the first base oil obtained in Step (a), and wherein, the second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.

In some embodiments, the present invention provides a process for improving MRV performance and decreasing wax crystallization in a lubricating oil, further comprising:

(a) obtaining a first base oil comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and (b) blending the second base oil with the first base oil obtained in Step (a), and wherein, the second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C., further comprising a third base oil, comprising: a VI between about 85 to 98, a kinematic viscosity between about 1.0 to 4.0 cSt at 100° C., a kinematic viscosity between about 6.0 to 14 cSt at 40° C., a flash point between about 150 to 172° C., and a pour point between about 0° C. to −6° C.

In some embodiments, the present invention provides a process for improving MRV performance and decreasing wax crystallization in a lubricating oil, further comprising:

(a) obtaining a first base oil comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and (b) blending the second base oil with the first base oil obtained in Step (a), and wherein, the second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C., further comprising a third base oil, comprising: a VI between about 85 to 98, a kinematic viscosity between about 1.0 to 4.0 cSt at 100° C., a kinematic viscosity between about 6.0 to 14 cSt at 40° C., a flash point between about 150 to 172° C., and a pour point between about 0° C. to −6° C.

In some embodiments, the present invention provides a process for improving MRV performance and decreasing wax crystallization in a lubricating oil, further comprising:

(a) obtaining a first base oil, comprising: at least about 60 wt % of the molecules have to paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.;

(b) blending a third base oil with the first base oil obtained in Step (a), wherein the third base oil comprises: a VI between about 88 to 95, a kinematic viscosity between about 2.0 to 3.0 cSt at 100° C., a flash point between about 158 to 164° C., and a pour point between about −1 to −4° C.; and (c) blending the second base oil with a base oil blend obtained in Step (b), wherein the second base oil, comprises: a VI between about 100 to 104, a Noack volatility between about 8.0 to 13 wt %, a kinematic viscosity between about 5.0 to 8.0 cSt at 100° C., a kinematic viscosity between about 39 to 47 cSt at 40° C., a flash point of about 208 to 234° C., total aromatics of less than 0.8 wt %, a CCS VIS at −20° C. between about 3300 to 3700 cP, and a pour point between about −11 to −14° C., and wherein, the multigrade engine oil comprises about 49.2 wt % of the first base oil and about 20 wt % of the second base oil and about 13 wt % of the third base oil.

In some embodiments, the present invention provides a process for improving MRV performance and decreasing wax crystallization in a lubricating oil, further comprising:

(a) a first base oil, comprising: at least about 60 wt % of the molecules have paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.;

(b) blending a third base oil with the first base oil obtained in Step (a), wherein the third base oil comprises: a VI between about 88 to 95, a kinematic viscosity between about 2.0 to 3.0 cSt at 100° C., a flash point between about 158 to 164° C., and a pour point between about −1 to −4° C.; and (c) blending the second base oil with a base oil blend obtained in Step (b), wherein the second base oil, comprises: a VI between about 94 to 102, a Noack volatility between about 10 to 14 wt %, a kinematic viscosity between about 5.5 to 7.5 cSt at 100° C., a kinematic viscosity between about 39 to 47 cSt at 40° C., a flash point between about 211 to 229° C., total aromatics of less than 2 wt %, a CCS VIS at −20° C. between about 3100 to 3900 cP, and a pour point between about −11 to −16° C., and wherein, the multigrade engine oil comprises about 49.2 wt % of the first base oil and about 20 wt % of the second base oil and about 13 wt % of the third base oil.

In some embodiments, the present invention provides a process for improving MRV performance and decreasing wax crystallization in a lubricating oil, comprising: replacing between about 5 to 60 wt % of a base oil or base oil blend with between about 5 to 60 wt % of a second base oil, further comprising the addition of an additive package.

In some embodiments, the present invention provides a process for improving MRV performance and decreasing wax crystallization in a lubricating oil, further comprising: (a) obtaining a first base oil, wherein the first base oil is Petrobras™ Paraffinic Light Neutral 30; and (b) blending the second base oil with the first base oil obtained in Step (a), wherein the second base oil is Chevron™ 220R.

In some embodiments, the present invention provides a process for improving MRV performance and decreasing wax crystallization in a lubricating oil, further comprising: (a) obtaining a first base oil, wherein the first base oil is Petrobras™ Paraffinic Light Neutral 30; and (b) blending the second base oil with the first base oil obtained in Step (a), wherein the second base oil is Motiva™ Star 6.

In some embodiments, the present invention provides a process for improving MRV performance and decreasing wax crystallization in a lubricating oil, wherein the third base oil is Petrobras™ Paraffinic Spindle 09.

In some embodiments, the present invention provides a process for improving MRV performance and decreasing wax crystallization in a lubricating oil, wherein the lubricating oil further comprises: an additive package comprising: (a) between about 5 to 15 wt % of a detergent and dispersant; (b) between about 3 to 9 wt % of a non-dispersant viscosity modifier; (b) between about 0.5 to 2 wt % of a friction reducing compound; (c) between about zero to 0.5 wt % of a pour point depressant; and (d) between about 0.001 to 0.008 wt % of a demulsifier.

In some embodiments, the present invention provides a process for improving MRV performance and decreasing wax crystallization in a lubricating oil, wherein the lubricating oil comprises: a multigrade engine oil meeting the specifications for SAE viscosity grade 0W-XX, 5W-XX, or 10W-XX engine oil, wherein XX represents the integer 20, 30, or 40.

In some embodiments, the present invention provides a process for improving MRV performance and decreasing wax crystallization in a lubricating oil, wherein the lubricating oil comprises: a multigrade engine oil having (a) an MRV at −30° C. of less than 50,000 and no yield stress; (b) a Noack volatility of less than about 15 wt % or 10 wt %.; (c) a Scanning Brookfield Viscosity between about 40,000 to 50,000 cP; and (d) a Pour Point between about −39 to −46° C.

In another embodiment, the present invention provides a multigrade engine oil comprising:

(a) a first base oil, comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.;

(b) a second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.; and (c) an additive package, and wherein, the multigrade engine oil comprises between about 30 to 50 wt % of the first base oil and about 10 to 30 wt % of the second base oil.

In some embodiments, the present invention provides a multigrade engine oil comprising:

(a) a first base oil, comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.;

(b) a second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.; and (c) an additive package, and wherein, the multigrade engine oil comprises between about 30 to 50 wt % of the first base oil and about 10 to 30 wt % of the second base oil.

In some embodiments, the present invention provides a multigrade engine oil comprising:

(a) a first base oil, comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.;

(b) a second base oil, comprises: hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.;

(c) a third base oil, comprising: a VI between about 85 to 98, a kinematic viscosity between about 1.0 to 4.0 cSt at 100° C., a kinematic viscosity between about 6.0 to 14 cSt at 40° C., a flash point between about 150 to 172° C., and a pour point between about 0° C. to −6° C.; and (d) an additive package, and wherein, the multigrade engine oil comprises between about 30 to 50 wt % of the first base oil, about 10 to 30 wt % of the second base oil and about 5 to 20 wt % of the third base oil.

In some embodiments, the present invention provides a multigrade engine oil comprising:

(a) a first base oil, comprising: at least about 55 wt % of the molecules have paraffinic functionality, at least about 25 wt % of the molecules have cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.;

(b) a second base oil, comprises: a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.;

(c) a third base oil, comprising: a VI between about 85 to 98, a kinematic viscosity between about 1.0 to 4.0 cSt at 100° C., a kinematic viscosity between about 6.0 to 14 cSt at 40° C., a flash point between about 150 to 172° C., and a pour point between about 0° C. to −6° C.; and (d) an additive package, and wherein, the multigrade engine oil comprises between about 30 to 50 wt % of the first base oil, about 10 to 30 wt % of the second base oil and about 5 to 20 wt % of the third base oil.

In some embodiments, the present invention provides that the first base oil is Petrobras™ Paraffinic Light Neutral 30 and the second base oil is Chevron™ 220R.

In some embodiments, the present invention provides that the first base oil is Petrobras™ Paraffinic Light Neutral 30 and the second base oil is Motiva™ Star 6.

In some embodiments, the present invention provides that the third base oil is Petrobras™ Paraffinic Spindle 09.

In some embodiments, the present invention provides a multigrade engine oil comprising:

(a) a first base oil, comprising: at least about 60 wt % of the molecules have paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.;

(b) a second base oil, comprising: a VI between about 100 to 104, a Noack volatility between about 8.0 to 13 wt %, a kinematic viscosity between about 5.0 to 8.0 cSt at 100° C., a kinematic viscosity between about 39 to 47 cSt at 40° C., a flash point of about 208 to 234° C., total aromatics of less than 0.8 wt %, a CCS VIS at −20° C. between about 3300 to 3700 cP, and a pour point between about −11 to −14° C.; and (c) a third base oil, comprising: a VI between about 88 to 95, a kinematic viscosity between about 2.0 to 3.0 cSt at 100° C., a flash point between about 158 to 164° C., and a pour point between about −1 to −4° C., and wherein, the multigrade engine oil comprises about 49.2 wt % of the first base oil and about 20 wt % of the second base oil and about 13 wt % of the third base oil.

In some embodiments, the present invention provides a multigrade engine oil comprising:

(a) a first base oil, comprising: at least about 60 wt % of the molecules have paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.;

(b) a second base oil, comprising: a VI between about 94 to 102, a Noack volatility between about 10 to 14 wt %, a kinematic viscosity between about 5.5 to 7.5 cSt at 100° C., a kinematic viscosity between about 39 to 47 cSt at 40° C., a flash point between about 211 to 229° C., total aromatics of less than 2 wt %, a CCS VIS at −20° C. between about 3100 to 3900 cP, and a pour point between about −11 to −16° C.; and (c) a third base oil, comprising: a VI between about 88 to 95, a kinematic viscosity between about 2.0 to 3.0 cSt at 100° C., a flash point between about 158 to 164° C., and a pour point between about −1 to −4° C., and wherein, the multigrade engine oil comprises about 49.2 wt % of the first base oil and about 20 wt % of the second base oil and about 13 wt % of the third base oil.

In some embodiments, the present invention provides a multigrade engine oil, wherein the additive package comprises: (a) between about 5 to 15 wt % of a detergent and dispersant; (b) between about 3 to 9 wt % of a non-dispersant viscosity modifier; (c) between about 0.5 to 2 wt % of a friction reducing compound; (d) between about zero to 0.5 wt % of a pour point depressant; and (e) between about 0.001 to 0.008 wt % of a demulsifier.

In some embodiments, the present invention provides a multigrade engine oil meeting the specifications for SAE viscosity grade 0W-XX, 5W-XX, or 10W-XX engine oil, wherein XX represents the integer 20, 30, or 40.

In some embodiments, the present invention provides a multigrade engine oil meeting the specifications for SAE viscosity grade 10W-30 engine oil.

In some embodiments, the present invention provides a multigrade engine oil having an MRV at −30° C. of less than 50,000 and no yield stress.

In some embodiments, the present invention provides a multigrade engine oil, having (a) an MRV at −30° C. of less than 50,000 and no yield stress; (b) a Noack volatility of less than about 15 wt % or 10 wt %.; (c) a Scanning Brookfield Viscosity between about 40,000 to 50,000 cP; and (d) a Pour Point between about −39 to −46° C.

I. Hydrocracking

The operating conditions in the hydrocracking zone are selected to convert a heavy hydrocarbon feedstock to a product slate containing greater than 20 wt %, greater than 25 wt %, or greater than 30 wt % of a waxy intermediate fraction which is upgraded to the original base oil. In different embodiments the operating conditions in the hydrocracking zone can be selected to convert a heavy hydrocarbon feedstock to a product slate containing from greater than 20 wt %, greater than 25 wt %, greater than 30 wt %, from greater than 32 wt %, or greater than 34 wt % of a waxy intermediate fraction. In different embodiments the operating conditions in the hydrocracking zone can be selected to convert a heavy hydrocarbon feedstock to a product slate containing less than 60 wt %, less than 50 wt %, less than 40 wt %, or less than 35 wt % of a waxy intermediate fraction. In one embodiment the operating conditions in the hydrocracking zone are selected to convert a heavy hydrocarbon feedstock to a product slate containing from greater than 20 wt %, greater than 25 wt %, or greater than 30 wt % to less than 40 wt % of a waxy intermediate.

The temperature in the hydrocracking zone will be within the range of from about 500° F. (260° C.) to about 900° F. (480° C.), such as within the range of from about 650° F. (345° C.) to about 800° F. (425° C.). A total pressure above 1000 psig is used. For example the total pressure can be above about 1500 psig, or above about 2000 psig. Although greater maximum pressures have been reported in the literature and may be operable, the maximum practical total pressure generally will not exceed about 3000 psig. Liquid hourly space velocity (LHSV) will usually fall within the range of from about 0.2 to about 5.0, such as from about 0.5 to about 1.5. The supply of hydrogen (both make-up and recycle) is preferably in excess of the stoichiometric amount needed to crack the target molecules and will usually fall within the range of from about 500 to about 20,000 standard cubic feet (SCF) per barrel. In one embodiment the hydrogen will be within the range from about 2000 to about 10,000 SCF per barrel.

The catalysts used in the hydrocracking zone are composed of natural and synthetic materials having hydrogenation and dehydrogenation activity. These catalysts are pre-selected to crack the target molecules and produce the desired product slate. The hydrocracking catalyst is selected to convert a heavy hydrocarbon feedstock to a product slate containing a commercially significant amount of a waxy intermediate fraction which will be upgraded to the original base stock. Exemplary commercial cracking catalysts generally contain a support consisting of alumina, silica, silica-alumina composites, silica-alumina-zirconia composites, silica-alumina-titania composites, acid treated clays, crystalline aluminosilicate zeolitic molecular sieves, such as zeolite A, faujasite, zeolite X, zeolite Y, and various combinations of the above. The hydrogenation/dehydrogenation components generally consist of a metal or metal compound of Group VIII or Group VIB of the periodic table of the elements. Metals and their compounds such as, for example, cobalt, nickel, molybdenum, tungsten, platinum, palladium and combinations thereof are known hydrogenation components of hydrocracking catalysts.

II. Seperating

Separating is done by distillation. The lower boiling fraction and higher boiling fractions may be separated by carefully controlled vacuum distillation having a tower top temperature, a tower bottom temperature, a tower top pressure and a tower bottom pressure that are selected to cleanly separate the hydrocarbons in the waxy intermediate fraction at a certain temperature. Various different types of vacuum distillation control systems may be employed, such as those taught in U.S. Pat. Nos. 3,365,386, 4,617,092, or 4,894,145, in order to provide the highest yields of desired fractions and exact cut points. Furthermore, the higher boiling fraction may be a bottoms fraction from the separating step. The lower boiling fraction is a distillate side cut.

III. Solvent Dewaxing

In one embodiment solvent dewaxing is used to dewax the lower boiling or the higher boiling fractions. Solvent dewaxing to make base oils has been used for over 70 years and is described, for example, in Chemical Technology of Petroleum, 3rd Edition, William Gruse and Donald Stevens, McGraw-Hill Book Company, Inc., New York, 1960, pages 566 to 570. The basic process involves:

mixing a waxy hydrocarbon stream with a solvent, chilling the mixture to cause wax crystals to precipitate, separating the wax by filtration, typically using rotary drum filters, recovering the solvent from the wax and the dewaxed oil filtrate.

The solvent can be recycled to the solvent dewaxing process. The solvent may comprise, for example, a ketone (such as methyl ethyl ketone or methyl iso-butyl ketone) and an aromatic (such as toluene). Other types of suitable solvents are C3-C6 ketones (e.g. methyl ethyl ketone, methyl isobutyl ketone and mixtures thereof), C6-C10 aromatic hydrocarbons (e.g. toluene), mixtures of ketones and aromatics (e.g. methyl ethyl ketone and toluene), autorefrigerative solvents such as liquefied, normally gaseous C2-C4 hydrocarbons such as propane, propylene, butane, butylene and mixtures thereof. A mixture of methyl ethyl ketone and methyl isobutyl ketone can also be used.

There have been refinements in solvent dewaxing since its inception. For example, Exxon's DILCHILL® dewaxing process involves cooling a waxy hydrocarbon oil stock in an elongated stirred vessel, preferably a vertical tower, with a pre-chilled solvent that will solubilize at least a portion of the oil stock while promoting the precipitation of the wax. Waxy oil is introduced into the elongated staged cooling zone or tower at a temperature above its cloud point. Cold dewaxing solvent is incrementally introduced into the cooling zone along a plurality of points or stages while maintaining a high degree of agitation therein to effect substantially instantaneous mixing of the solvent and wax/oil mixture as they progress through the cooling zone, thereby precipitating at least a portion of the wax in the oil. DILCHILL® dewaxing is discussed in greater detail in the U.S. Pat. Nos. 4,477,333, 3,773,650, and 3,775,288. Texaco also has developed refinements in the process. For example, U.S. Pat. No. 4,898,674 discloses how it is important to control the ratio of methyl ethyl ketone (MEK) to toluene and to be able to adjust this ratio, since it allows use of optimum concentrations for processing various base stocks. Commonly, a ratio of 0.7:1 to 1:1 may be used when processing bright stocks; and a ratio of 1.2:1 to about 2:1 may be used when processing light stocks.

The wax mixture is typically chilled to a temperature in the range of from −10° C. to −40° C., or in the range of from −20° C. to −35° C., to cause the wax crystals to precipitate. Separating the wax by filtration may use a filter comprising a filter cloth which can be made of textile fibers, such as cotton; porous metal cloth; or cloth made of synthetic materials.

The solvent dewaxing conditions can include that amount of solvent that when added to the waxy hydrocarbon stream will be sufficient to provide a liquid/solid weight ratio of about 5:1 to about 20:1 at the dewaxing temperature and a solvent/oil volume ratio between 1.5:1 to 5:1.

IV. Hydroisomerization

The highly paraffinic waxes are subjected to a process comprising hydroisomerization to provide the base oil of the lubricant composition. Hydroisomerization is intended to improve the cold flow properties of the base oil by the selective addition of branching into the molecular structure. Hydroisomerization ideally will achieve high conversion levels of the highly paraffinic wax to non-waxy iso-paraffins while at the same time minimizing the conversion by cracking. In an embodiment, the conditions for hydroisomerization are controlled such that the conversion of the compounds boiling above about 700° F. in the waxy feed to compounds boiling below about 700° F. is maintained between about 10 and 50 wt %, for example between 15 and 45 wt %.

Hydroisomerization is conducted using a shape selective intermediate pore size molecular sieve. The hydroisomerization catalysts used comprise a shape selective intermediate pore size molecular sieve and optionally a catalytically active metal hydrogenation component on a refractory oxide support. The phrase "intermediate pore size", as used herein, means an effective pore aperture in the range of from about 3.9 to about 7.1 Å when the porous inorganic oxide is in the calcined form. The shape selective intermediate pore size molecular sieves used are generally 1-D 10-, 11- or 12-ring molecular sieves. In an embodiment, the molecular sieves are of the 1-D 10-ring variety, where 10- (or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings can also be encompassed within the definition of molecular sieve. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Other shape selective intermediate pore size molecular sieves used for hydroisomerization are based upon aluminum phosphates, such as SAPO-11, SAPO-31, and SAPO-41. SM-3 is an example of a good shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Metal loaded small crystallite MTT molecular sieves are also good shape selective intermediate pore size molecular sieves. The preparation of metal loaded small crystallite MTT molecular sieve catalysts are described in U.S. patent application Ser. No. 11/866,281, filed Oct. 2, 2007. Other shape selective intermediate pore size molecular sieves used for hydroisomerization are zeolites, such as ZSM-22, ZSM-23, ZSM-35, ZSM-48, ZSM-57, SSZ-32, offretite, and ferrierite.

In an embodiment, an intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Å, having a maximum crystallographic free diameter of not more than 7.1 and a minimum crystallographic free diameter of not less than 3.9 Å. The maximum crystallographic free diameter may be not more than 7.1 and the minimum crystallographic free diameter is not less than 4.0 Å. The maximum crystallographic free diameter may be not more than 6.5 and the minimum crystallographic free diameter is not less than 4.0 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15.

An example of an intermediate pore size molecular sieve is described, for example, in U.S. Pat. Nos. 5,135,638 and 5,282,958. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1

Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(wt % branched $C_{16}$ in product)/(wt % branched $C_{16}$ in product+ wt % $C_{13}$_in product) when used under conditions leading to 96% conversion of normal hexadecane (n-$C_{16}$) to other species.

The molecular sieve can further be characterized by pores or channels having a crystallographic free diameter in the range of from about 4.0 to about 7.1 Å, for example, in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 to 6.5 Å with little hindrance.

Hydroisomerization catalysts often comprise a catalytically active hydrogenation metal. The presence of a catalytically active hydrogenation metal leads to product improvement, especially viscosity index and stability. Typical catalytically active hydrogenation metals include chromium, molybdenum, nickel, vanadium, cobalt, tungsten, zinc, platinum, and palladium. In an embodiment the catalytically active hydrogen metals are selected from platinum, palladium, and mixtures thereof. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support can be selected from those oxide supports, which are conventionally used for catalysts, including silica, alumina, silica-alumina, magnesia, titania and combinations thereof.

The conditions for hydroisomerization will be tailored to achieve a base oil comprising greater than 5 wt % molecules with cycloparaffinic functionality. The conditions can provide a base oil comprising a ratio of weight percent of molecules with monocycloparaffinic functionality of weight percent of molecules with multicycloparaffinic functionality of greater than 5, such as greater than 10, greater than 15, or greater than 20. The conditions for hydroisomerization will depend on the properties of feed used, the catalyst used, whether or not the catalyst is sulfided, the desired yield, and the desired properties of the base oil. Conditions under which the hydroisomerization process can be carried out include temperatures from about 500° F. to about 775° F. (260° C. to about 413° C.), such as 600° F. to about 750° F. (315° C. to about 399° C.), or 600° F. to about 700° F. (315° C. to about 371° C.); and pressures from about 15 to 3000 psig, such as 100 to 2500 psig. The hydroisomerization pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 $hr^{-1}$, for example, from about 0.1 to about 5 $hr^{-1}$. The hydrogen to hydrocarbon ratio falls within a range from about 1.0 to about 50 moles $H_2$ per mole hydrocarbon, for example, from about 10 to about 20 moles $H_2$ per mole hydrocarbon. Suitable conditions for performing hydroisomerization are described in U.S. Pat. Nos. 5,282,958 and 5,135,638.

The hydroisomerization conditions may be are selected to produce a base oil having between 2 and 10 wt % naphthenic carbon, between 90 and 98 wt % paraffinic carbon, and less than 1 wt % aromatic carbon by n-d-M with normalization. N-d-M analysis is done by ASTM D 3238-95 (Reapproved 2005) with normalization. Weight percent aromatic carbon ("Ca", weight percent napthenic carbon ("Cn") and weight percent paraffinic carbon ("Cp") in an embodiment can be measured by ASTM D3238-95 (Reapproved 2005) with normalization. ASTM D3238-95 (Reapproved 2005) is the Standard Test Method for Calculation of Carbon Distribution and Structural Group Analysis of Petroleum Oils by the n-d-M Method. This method is for "olefin free" feedstocks which are assumed in this application to mean that that olefin content is 2 wt % or less. The normalization process consists of the following: A) If the Ca value is less than zero, Ca is set to zero, and Cn and Cp are increased proportionally so that the sum is 100%; B) If the Cn value is less than zero, Cn is set to zero, and Ca and Cp are increased proportionally so that the sum is 100%; and C) If both Cn and Ca are less than zero, Cn and Ca are set to zero, and Cp is set to 100%.

Hydrogen is present in the reaction zone during the hydroisomerization process, typically in a hydrogen to feed ratio from about 0.5 to 30 MSCF/bbl (thousand standard cubic feet per barrel), such as from about 1 to about 10 MSCF/bbl. The hydrogen to feed ratio may be from about 712.4 to about 3562 liter $H_2$/liter oil (about 4 to about 20 MSCF/bbl). Hydrogen will sometimes be separated from the product and recycled to the reaction zone.

V. Hydrotreating

The highly paraffinic waxy feed to the hydroisomerization process will sometimes be hydrotreated prior to hydroisomerization. Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules is minimized, and the unsaturated hydrocarbons are either fully or partially hydrogenated.

VI. Hydrofinishing

Hydrofinishing is a hydrotreating process that will often be used as a step following hydroisomerization to provide base oil derived from highly paraffinic wax. Hydrofinishing can be employed to improve oxidation stability, UV stability, and appearance of base oil by removing traces of aromatics, olefins, color bodies, and solvents. As used herein, the term UV stability refers to the stability of base oil or lubricant compositions when exposed to UV light and oxygen. Instability is indicated when a visible precipitate forms, usually seen as floc or cloudiness, or a darker color develops upon exposure to ultraviolet light and air. A general description of hydrofinishing can be found in U.S. Pat. Nos. 3,852,207 and 4,673, 487. Clay treating to remove impurities is an alternative final process step to provide base oil derived from highly paraffinic wax.

VII. Fractionation

Optionally, the process to provide the light base oil derived from highly paraffinic wax can include fractionating the highly paraffinic waxy feed prior to hydroisomerization, or fractionating of base oil obtained from the hydroisomerization process. The fractionation of the highly paraffinic waxy feed or the isomerized base oil into fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons can take place leading to fouling of the equipment and to lower yields of the heavier cuts. Vacuum distillation is typically used to separate the higher boiling material, such as base oil, into different boiling range cuts. Fractionating base oil into different boiling range cuts enables base oil manufacturing plant to produce more than one grade, or viscosity, of base oil.

VIII. Aromatics Measurement by HPLC-UV

The method used to measure low levels of molecules with aromatic functionality in the base oils uses a Hewlett Packard 1050 Series Quaternary Gradient High Performance Liquid Chromatography (HPLC) system coupled with a HP 1050 Diode-Array UV-Vis detector interfaced to an HP Chemstation. Identification of the individual aromatic classes in the highly saturated base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with cycloparaffinic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and cycloparaffinic substitution on the ring system. These bathochromic shifts are well known to be caused by alkyl-group delocalization of the $\pi$-electrons in the aromatic ring. Since few unsubstituted aromatic compounds boil in the lubricant range, some degree of red-shift was expected and observed for all of the principle aromatic groups identified.

Quantification of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III base oils.

IX. HPLC-UV Calibration

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-cycloalkyl-1-ring aromatics and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-cycloalkyl-1-ring aromatics in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the base oil using a Waters semi-preparative HPLC unit. Ten grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

X. Confirmation of Aromatics by NMR

The weight percent of molecules with aromatic functionality in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

XI. Engine oil Composition

Base oils are the most important component of lubricant compositions, generally comprising greater than 70% of the lubricant compositions. Lubricant compositions comprise a base oil and at least one additive. Lubricant compositions can be used in automobiles, diesel engines, axles, transmissions, and industrial applications. Lubricant compositions must meet the specifications for their intended application as defined by the concerned governing organization.

Additives, which can be blended with the base oil, to provide a lubricant composition include those which are intended to improve select properties of the lubricant composition. Typical additives include, for example, anti-wear additives, extreme pressure agents, detergents (e.g., metal-containing detergents), dispersants (e.g., ashless dispersants), antioxidants, pour point depressants, VI Improvers (VII), viscosity modifiers, friction modifiers, demulsifiers, antifoaming agents, inhibitors (e.g., corrosion inhibitors, rust inhibitors, etc.), seal swell agents, emulsifiers, wetting agents, lubricity improvers, metal deactivators, gelling agents, tackiness agents, bactericides, fluid-loss additives, colorants, and the like. Additives can be added in the form of an additive package, containing various additives.

Dispersants: Dispersants are generally used to maintain in suspension insoluble materials resulting from oxidation during use, thus preventing sludge flocculation and precipitation or deposition on engine parts. Examples of dispersants include nitrogen-containing ashless (metal-free) dispersants. An ashless dispersant generally comprises an oil soluble polymeric hydrocarbon backbone having functional groups that are capable of associating with particles to be dispersed. Other examples of dispersants include, but are not limited to, amines, alcohols, amides, or ester polar moieties attached to the polymer backbones via bridging groups.

An ashless dispersant may be selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine Carboxylic dispersants are reaction products of carboxylic acylating agents (acids, anhydrides, esters, etc.) comprising at least 34 and preferably at least 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters, e.g., succinimide dispersants.

Other suitable ashless dispersants may also include amine dispersants, which are reaction products of relatively high molecular weight aliphatic halides and amines, preferably polyalkylene polyamines. Other examples may further include "Mannich dispersants," which are reaction products of alkyl phenols in which the alkyl group contains at least 30 carbon atoms with aldehydes (especially formaldehyde) and amines (especially polyalkylene polyamines). Furthermore, ashless dispersants may even include post-treated dispersants, which are obtained by reacting carboxylic, amine or Mannich dispersants with reagents such as dimercaptothiazoles, urea, thiourea, carbon disulfide, aldehydes, ketones, carboxylic acids, hydrocarbon-substituted succinic anhydrides, nitrile epoxides, boron compounds and the like. Suitable ashless dispersants may be polymeric, which are interpolymers of oil-solubilizing monomers such as decyl methacrylate, vinyl decyl ether and high molecular weight olefins with monomers containing polar substitutes. Other suitable ashless dispersants may also include an ethylene carbonate-treated bissuccinimide derived from a polyisobutylene having a number average molecular weight of about 2300 Daltons ("PIBSA 2300").

Viscosity Index Improvers (Modifiers): The viscosity index of an engine oil base stock can be increased, or improved, by incorporating therein certain polymeric materials that function as viscosity modifiers (VM) or viscosity index improvers (VII) in an amount of 0.3 to 25 wt %. of the final weight of the engine oil. Examples include but are not limited to olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof.

Friction Modifiers: The lubricating oil composition may comprise at least a friction modifier (e.g., a sulfur-containing molybdenum compound). Certain sulfur-containing organo-molybdenum compounds are known to modify friction in lubricating oil compositions, while also offering antioxidant and antiwear credits. Examples of oil soluble organo-molybdenum compounds include molybdenum succinimide complex, dithiocarbamates, dithiophosphates, dithiophosphinates, xanthates, thioxanthates, sulfides, and the like, and mixtures thereof.

Other examples include at least a mono-, di- or triester of a tertiary hydroxyl amine and a fatty acid as a friction modifying fuel economy additive. Other examples are selected from the group of succinamic acid, succinimide, and mixtures thereof. Other examples are selected from an aliphatic fatty amine, an ether amine, an alkoxylated aliphatic fatty amine, an alkoxylated ether amine, an oil-soluble aliphatic carboxylic acid, a polyol ester, a fatty acid amide, an imidazoline, a tertiary amine, a hydrocarbyl succinic anhydride or acid reacted with an ammonia or a primary amine, and mixtures thereof.

Seal swelling agents: Seal fixes are also termed seal swelling agents or seal pacifiers. They are often employed in lubricant or additive compositions to insure proper elastomer sealing, and prevent premature seal failures and leakages. Seal swell agents may be selected from oil-soluble, saturated, aliphatic, or aromatic hydrocarbon esters such as di-2-ethylhexylphthalate, mineral oils with aliphatic alcohols such as tridecyl alcohol, triphosphite ester in combination with a hydrocarbonyl-substituted phenol, and di-2-ethylhexylsebacate.

Corrosion inhibitors (Anti-corrosive agents): These additives are typically added to reduce the degradation of the metallic parts contained in the engine oil in amounts from about 0.02 to 1 wt %. Examples include zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester. The rust inhibitor or anticorrosion agents may be a nonionic polyoxyethylene surface active agent. Nonionic polyoxyethylene surface active agents include, but are not limited to, polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Rust inhibitors or anticorrosion agents may also be other compounds, which include, for example, stearic acid and other fatty acids, dicarboxylic acids, metal soaps, fatty acid amine salts, metal salts of heavy sulfonic acid, partial carboxylic acid ester of polyhydric alcohols, and phosphoric esters. The rust inhibitor may be a calcium stearate salt.

Detergents: In engine oil compositions, metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound.

The engine oil composition may contain one or more detergents, which are normally salts (e.g., overbased salts. Overbased salts, or overbased materials), are single phase, homogeneous Newtonian systems characterized by a metal content in excess of that which would be present according to the stoichiometry of the metal and the particular acidic organic compound reacted with the metal. The engine oil composition may comprise at least a carboxylate detergent. Carboxylate detergents, e.g., salicylates, can be prepared by reacting an aromatic carboxylic acid with an appropriate metal compound such as an oxide or hydroxide. The engine oil composition may comprise at least an overbased detergent. Examples of the overbased detergents include, but are not limited to calcium sulfonates, calcium phenates, calcium salicylates, calcium stearates and mixtures thereof. Overbased detergents may be low overbased (e.g., Total Base Number (TBN) below about 50). Suitable overbased detergents may alternatively be high overbased (e.g., TBN above about 150) or medium overbased (e.g., TBN between 50 and 150). The lubricating oil compositions may comprise more than one overbased detergents, which may be all low-TBN detergents, all high-TBN detergents, or a mix of those two types. Other suitable detergents for the lubricating oil compositions include "hybrid" detergents such as, for example, phenate/salicylates, sulfonate/phenates, sulfonate/salicylates, sulfonates/phenates/salicylates, and the like. The composition may comprise detergents made from alkyl benzene and fuming sulfonic acid, phenates (high overbased, medium overbased, or low overbased), high overbased phenate stearates, phenolates, salicylates, phosphonates, thiophosphonates, sulfonates, carboxylates, ionic surfactants and sulfonates and the like.

Oxidation Inhibitors/Antioxidants: Oxidation inhibitors or antioxidants reduce the tendency of mineral oils to deteriorate in service, which deterioration is evidenced by the products of oxidation such as sludge, lacquer, and varnish-like deposits on metal surfaces. The engine oil composition may contain from about 50 ppm to about 5.00 wt % of at least an antioxidant selected from the group of phenolic antioxidants, aminic antioxidants, or a combination thereof. The amount of antioxidants may be between 0.10 to 3.00 wt %. The amount of antioxidants may be between about 0.20 to 0.80 wt %. An example of an antioxidant used is di-C8-diphenylamine, in an amount of about 0.05 to 2.00 wt % of the total weight of the oil composition. Other examples of antioxidants include MoS and Mo oxide compounds.

Other examples of antioxidants include hindered phenols; alkaline earth metal salts of alkylphenolthioesters having C5 to C12 alkyl side chains; calcium nonylphenol sulphide; oil soluble phenates and sulfurized phenates; phosphosulfurized or sulfurized hydrocarbons or esters; phosphorous esters; metal thiocarbamates; oil soluble copper compounds known in the art; phenyl naphthyl amines such as phenylene diamine, phenothiazine, diphenyl amine, diarylamine; phenyl-alpha-naphthylamine, 2,2'-diethyl-4,4'-dioctyl diphenylamine, 2,2'diethyl-4-t-octyldiphenylamine; alkaline earth metal salts of alkylphenol thioesters, having C5 to C12 alkyl side chains, e.g., calcium nonylphenol sulfide, barium t-octylphenol sulfide, zinc dialkylditbiophosphates, dioctylphenylamine, phenylalphanaphthylamine and mixtures thereof. Some of these antioxidants further function as corrosion inhibitors. Other suitable antioxidants which also function as antiwear agents include bis alkyl dithiothiadiazoles such as 2,5-bis-octyl dithiothiadiazole.

Anti-foamants: The engine oil may comprise an anti-foamant (foam inhibitor) in amounts ranging from about 5 to about 50 ppm. Examples include alkyl methacrylate polymers, dimethyl silicone polymers, and foam inhibitors of the polysiloxane type, e.g., silicone oil and polydimethyl siloxane, for foam control. The anti-foamant may be a mixture of polydimethyl siloxane and fluorosilicone. Another example of an anti-foamant may be an acrylate polymer anti-foamant, with a weight ratio of the fluorosilicone antifoamant to the acrylate anti-foamant ranging from about 3:1 to about 1:4. Another example of an anti-foamant may be an anti-foam-effective amount of a silicon-containing anti-foamant such that the total amount of silicon in the engine oil is at least 30 ppm. The silicon-containing antifoam agent may be selected from the group consisting of fluorosilicones, polydimethylsiloxane, phenyl-methyl polysiloxane, linear siloxanes, cyclic siloxanes, branched siloxanes, silicone polymers and copolymers, organo-silicone copolymers, and mixtures thereof.

Anti-wear agents: Anti-wear agents can also be added to the engine oil composition. The composition may comprise at least an anti-wear agent selected from phosphates, phosphites, carbamates, esters, sulfur containing compounds, and molybdenum complexes. Other representative of suitable antiwear agents are zinc dialkyldithiophosphate, zinc diaryldilhiophosphate, Zn or Mo dithiocarbamates, phosphites, amine phosphates, borated succinimide, magnesium sulfonate, and mixtures thereof. The composition may comprise at least a dihydrocarbyl dithiophosphate metal as antiwear and antioxidant agent in amounts of about 0.1 to about 10 wt %. The metal may be an alkali or alkaline earth metal, or aluminum, lead, tin, molybdenum, manganese, nickel or copper.

Extreme Pressure Agents: The engine oil composition may comprise an extreme pressure agent. Examples include alkaline earth metal borated extreme pressure agents and alkali metal borated extreme pressure agents. Other examples include sulfurized olefins, zinc dialky-1-dithiophosphate (primary alkyl, secondary alkyl, and aryl type), di-phenyl sulfide, methyl tri-chlorostearate, chlorinated naphthalene, fluoroalkylpolysiloxane, lead naphthenate, neutralized or partially neutralized phosphates, di-thiophosphates, and sulfur-free phosphates.

Some of the above-mentioned additives can provide a multiplicity of effects; thus for example, a single additive may act as a dispersant as well as an oxidation inhibitor. These multifunctional additives are well known. Furthermore, when the engine oil composition contains one or more of the above-mentioned additives, each additive is typically blended into the base oil in an amount that enables the additive to provide its desired function. It may be desirable, although not essential to prepare one or more additive concentrates comprising additives (concentrates sometimes being referred to as "additive packages") whereby several additives can be added simultaneously to the oil to form the end oil composition. The final composition may employ from about 0.5 to about 30 wt % of the concentrate, the remainder being the oil of lubricating viscosity. The components can be blended in any order and can be blended as combinations of components.

Definitions and Terms

The following terms will be used throughout the specification and will have the following meanings unless otherwise indicated.

The phrase "Group I Base Oil" contain less than 90 percent saturates and/or greater than 0.03 percent sulfur and have a viscosity index greater than or equal to 80 and less than 120 using the ASTM methods specified in Table E-1 of American Petroleum Institute Publication 1509.

The term "Group II Base Oil" refers to a base oil which contains greater than or equal to 90% saturates and less than or equal to 0.03% sulfur and has a viscosity index greater than or equal to 80 and less than 120 using the ASTM methods specified in Table E-1 of American Petroleum Institute Publication 1509.

The term "Group II+ Base Oil" refers to a Group II base oil having a viscosity index greater than or equal to 110 and less than 120.

The term "Group III Base Oil" refers to a base oil which contains greater than or equal to 90% saturates and less than or equal to 0.03% sulfur and has a viscosity index greater than or equal to 120 using the ASTM methods specified in Table E-1 of American Petroleum Institute Publication 1509.

The term "Fischer-Tropsch derived" means that the product, fraction, or feed originates from or is produced at some stage by a Fischer-Tropsch process.

The term "petroleum derived" means that the product, fraction, or feed originates from the vapor overhead streams from distilling petroleum crude and the residual fuels that are the non-vaporizable remaining portion. A source of the petroleum derived product, fraction, or feed can be from a gas field condensate.

The term "multigrade engine oil" refers to an engine oil that has viscosity/temperature characteristics which fall within the limits of two different SAE numbers in SAE J300. The present invention is directed to the discovery that multigrade engine oils meeting the specifications under SAE J300 as revised January 2009, including the MRV viscosity specifications, may be prepared from Fischer-Tropsch base oils having a defined cycloparaffin functionality when they are blended with a pour point depressing base oil blending component and an additive package.

Highly paraffinic wax means a wax having a high content of n-paraffins, generally greater than 40 wt %, but can be greater than 50 wt %, or even greater than 75 wt %, and less than 100 wt % or 99 wt %. Examples of highly paraffinic waxes include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof.

The term "derived from highly paraffinic wax" means that the product, fraction, or feed originates from or is produced at some stage by from a highly paraffinic wax.

Aromatics means any hydrocarbonaceous compounds that contain at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

Molecules with cycloparaffinic functionality mean any molecule that is, or contains as one or more substituents, a monocyclic or a fused multicyclic saturated hydrocarbon group. The cycloparaffinic group can be optionally substituted with one or more, such as one to three, substituents. Representative examples include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group can be optionally substituted with one or more, such as one to three, substituents. Representative examples include, but are not limited to, cyclopropyl, cyclobutyl, cyclohexyl, cyclopentyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group often is of two fused rings. The cycloparaffinic group can be optionally substituted with one or more, such as one to three, substituents. Representative examples include, but are not limited to, decahydronaphthalene, octahydropentalene, 3,7,10-tricyclohexylpentadecane, decahydro-1-(pentadecan-6-yl) naphthalene, and the like.

Brookfield Viscosity: ASTM D2983-04a is used to determine the low-shear-rate viscosity of automotive fluid lubricants at low temperatures. The low-temperature, low-shear-rate viscosity of automatic transmission fluids, gear oils, torque and tractor fluids, and industrial and automotive hydraulic oils are frequently specified by Brookfield viscosities.

Kinematic viscosity is a measurement of the resistance to flow of a fluid under gravity. Many base oils, lubricant compositions made from them, and the correct operation of equipment depends upon the appropriate viscosity of the fluid being used. Kinematic viscosity is determined by ASTM D445-06. The results are reported in $mm^2/s$ Viscosity index (VI) is an empirical, unitless number indicating the effect of temperature change on the kinematic viscosity of the oil. Viscosity index is determined by ASTM D2270-04.

Pour point is a measurement of the temperature at which a sample of base oil will begin to flow under carefully controlled conditions. Pour point can be determined as described in ASTM D5950-02. The results are reported in degrees Celsius. Many commercial base oils have specifications for pour point. When base oils have low pour points, the base oils are also likely to have other good low temperature properties, such as low cloud point, low cold filter plugging point, and low temperature cranking viscosity.

Noack volatility is usually tested according to ASTM D5800-05 Procedure B. A more convenient method for calculating Noack volatility and one which correlates well with ASTM D5800-05 is by using a thermogravimetric analyzer (TGA) test by ASTM D6375-05. TGA Noack volatility is used throughout the present disclosure unless otherwise stated.

The base oils of the lubricant composition as disclosed herein also have excellent viscometric properties under low temperature and high shear, making them very useful in multigrade engine oils. The cold-cranking simulator apparent viscosity (CCS VIS) is a test used to measure the viscometric properties of base oils under low temperature and high shear. The test method to determine CCS VIS is ASTM D5293-02. Results are reported in mPa·s. CCS VIS has been found to correlate with low temperature engine cranking. Specifications for maximum CCS VIS are defined for automotive engine oils by SAE J300, revised in January 2009. The maximum CCS VIS for a 0W SAE Viscosity Grade engine oil is 6200 mPa·s at −35° C.

The Mini-Rotary Viscometer (MRV) test, ASTM D4684-07, which is related to the mechanism of pumpability, is a low shear rate measurement. Slow sample cooling rate is the method's key feature. A sample is pretreated to have a specified thermal history which includes warming, slow cooling, and soaking cycles. The MRV measures an apparent yield stress, which, if greater than a threshold value, indicates a potential air-binding pumping failure problem. Above a certain viscosity (currently defined as 60,000 mPa·s by SAE J300 2009), the oil may be subject to pumpability failure by a mechanism called "flow limited" behavior. An SAE 0W oil, for example, is required to have a maximum viscosity of 60,000 mPa·s at −40° C. with no yield stress. This method also measures an apparent viscosity under shear rates of 1 to 50 $s^{-1}$.

High temperature high shear rate viscosity (HTHS) is a measure of a fluid's resistance to flow under conditions resembling highly-loaded journal bearings in fired internal combustion engines, typically 1 million $s^{-1}$ at 150° C. HTHS is a better indication of how an engine operates at high temperature with a given lubricant than the kinematic low shear rate viscosities at 100° C. The HTHS value directly correlates to the oil film thickness in a bearing. SAE J300 2009 contains the current specifications for HTHS measured by ASTM D4683, ASTM D4741, or ASTM D5481. An SAE 20 viscosity grade engine oil, for example, is required to have a minimum HTHS of 2.6 mPa·s.

Scanning Brookfield Viscosity: ASTM D5133-05 is used to measure the low temperature, low shear rate, viscosity/temperature dependence of engine oils. The low temperature, low shear viscometric behavior of an engine oil determines whether the oil will flow to the sump inlet screen, then to the oil pump, then to the sites in the engine requiring lubrication in sufficient quantity to prevent engine damage immediately or ultimately after cold temperature starting. ASTM D5133-05, the Scanning Brookfield Viscosity technique, measures the Brookfield viscosity of a sample as it is cooled at a constant rate of 1° C./hour. Like the MRV, ASTM D5133-05 is intended to relate to the pumpability of an oil at low temperatures. The test reports the gelation point, defined as the temperature at which the sample reaches 30,000 mPa·s. The gelation index is also reported, and is defined as the largest rate of change of viscosity increase from −5° C. to the lowest test temperature. The latest API SM/ILSAC GF-4 specifications for passenger car engine oils require a maximum gelation index of 12.

Unless otherwise indicated herein, scientific and technical terms used in connection with the present invention shall have the meanings that are commonly understood by those of ordinary skill in the art. Further, unless otherwise required by context, singular terms shall include pluralities and plural terms shall include the singular. More specifically, as used in this specification and the appended claims, the singular forms "a", "an" and "the" include plural referents unless the context clearly dictates otherwise. Thus, for example, reference to "a fatty acid" includes a plurality of fatty acids, and the like. In addition, ranges provided in the specification and appended claims include both end points and all points between the end points. Therefore, a range of 2.0 to 3.0 includes 2.0, 3.0 and all points between 2.0 and 3.0. Furthermore, all numbers expressing quantities, percentages or proportions, and other numerical values used in the specification and claims, are to be understood as being modified in all instances by the term "about". As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Motiva™ Star 6 refers to a base oil with the properties of Table 1.

TABLE 1

| Specification Test | Parameter | Unit of Measure | Test Method | Min | Max | Typical |
|---|---|---|---|---|---|---|
| Appearance | | | BSERVATION | Clear & Bright | | |
| Infrared Scan | | | ASTM E1252 | Conform to Standard | | |

TABLE 1-continued

| Specification Test | Parameter | Unit of Measure | Test Method | Min | Max | Typical |
|---|---|---|---|---|---|---|
| API Gravity | | °API | ASTM D287 | Report | | 31.5 |
| Flash Point, COC | | ° C. | ASTM D92 | 216 | | 225 |
| Kinematic Viscosity | 40° C. | $mm^2/s$ | ASTM D445 | 40.0 | 46.0 | 42.1 |
| Kinematic Viscosity | 100° C. | $mm^2/s$ | ASTM D445 | 6.1 | | 6.39 |
| Apparent Viscosity, CCS | −20° C. | mPa · s | ASTM D5293 | | 3900 | 3200 |
| Viscosity Index | | | ASTM D2270 | 95 | | 100 |
| Sulfur | | mass % | X-ray/ICP | | 0.03 | 0.0015 |
| ASTM Color | | | ASTM D1500 | | 1.0 | 0.5 |
| Pour Point | | ° C. | ASTM D97 | | −12 | −15 |
| HPLC Analysis | | | | | | |
| Aromatics | | mass % | HPLC | | 2.0 | 1.5 |
| Boiling Range Distribution, GC | | | ASTM D2887 | | | |
| Percent Recovered | 700° F. | mass % | ASTM D2887 | | 7.0 | 6.0 |
| Noack Evaporation Loss, Proc B | 1 h, 250° C. | mass % | ASTM D5800 | Report | 13 | 11 |
| Relative Density | 15.6/15.6° C. | | ASTM D1298 | | | 0.8681 |
| Density | 60° F. | lb/gal | ASTM D1298 | | | 7.228 |
| Density | 15° C. | kg/L | ASTM D1298 | | | 0.8676 |

Petrobras™ Paraffinic Light Neutral 30 refers to a base oil with the properties of Table 2.

TABLE 2

| Specification Test | Parameter | Unit of Measure | Test Method | Min | Max | Typical |
|---|---|---|---|---|---|---|
| Aniline Point | | ° C. | ASTM D611 | | | 99.8 |
| Ash | | mass % | ASTM D482 | | 0.005 | |
| Carbon Distribution | | | ASTM D3238 | | | |
| Aromatic Carbon | | mass % | ASTM D3238 | | | 6.0 |
| Naphthenic Carbon | | mass % | ASTM D3238 | | | 31.0 |
| Paraffinic Carbon | | mass % | ASTM D3238 | | | 63.0 |
| Copper Corrosion | 3 h, 100° C. | | ASTM D130 | | 1B | |
| Carbon-Type Composition | | | ASTM D2140 | | | |
| Refractivity Intercept | | | ASTM D2140 | | | 1.0451 |
| Flash Point, COC | | ° C. | ASTM D92 | 200 | | 218 |
| Infrared Scan | | | ASTM E1252 | Conform to Standard | | |
| Pour Point | | ° C. | ASTM D97 | | −6 | −9 |
| Micro Method Carbon Residue | | mass % | ASTM D4530 | | 0.10 | |
| Refractive Index | 20° C. | | ASTM D1218 | | | 1.478 |
| Sulfur | | mass % | ASTM D1552 | REPORT | | |
| Viscosity-Gravity Constant | | | ASTM D2501 | | | 0.828 |
| Water by Distillation | | volume % | ASTM D95 | ABSENT | | |
| Acid Number | | mg KOH/g | ASTM D974 | 0.05 | 0.01 | |
| Appearance | | | OBSERVATION | CLEAR | | |
| ASTM Color | | | ASTM D1500 | | 1.5 | |
| Density | 20° C. | kg/L | ASTM D1298 | | | 0.866 |
| Kinematic Viscosity | 40° C. | $mm^2/s$ | ASTM D445 | 27.0 | 31.0 | 28.2 |
| Kinematic Viscosity | 100° C. | $mm^2/s$ | ASTM D445 | | | 5.00 |
| Viscosity Index | | | ASTM D2270 | 100 | | 102 |

Petrobras™ Paraffinic Spindle 09 refers to a base oil with the properties of Table 3.

TABLE 3

| Specification Test | Parameter | Unit of Measure | Test Method | Min | Max | Typical |
|---|---|---|---|---|---|---|
| Aniline Point | | ° C. | ASTM D611 | | | 89.0 |
| Ash | | mass % | ASTM D482 | | 0.005 | 0.01 |
| Carbon Distribution | | | ASTM D3238 | | | |
| Aromatic Carbon | | mass % | ASTM D3238 | | | 5 |
| Naphthenic Carbon | | mass % | ASTM D3238 | | | 27 |
| Paraffinic Carbon | | mass % | ASTM D3238 | | | 68 |
| Carbon-Type Composition | | | ASTM D2140 | | | |
| Refractivity Intercept | | | ASTM D2140 | | | 1.046 |

TABLE 3-continued

| Specification Test | Parameter | Unit of Measure | Test Method | Min | Max | Typical |
|---|---|---|---|---|---|---|
| Infrared Scan | | | ASTM E1252 | Conform to Standard | | |
| Micro Method Carbon Residue | | mass % | ASTM D4530 | | 0.1 | 0.04 |
| Refractive Index | 20° C. | | ASTM D1218 | | | 1.470 |
| Sulfur | | mass % | ASTM D1552 | | | 0.23 |
| Viscosity-Gravity Constant | | | ASTM D2501 | | | 0.818 |
| Water by Distillation | | volume % | ASTM D95 | ABSENT | | |
| Acid Number | | mg KOH/g | ASTM D974 | | 0.05 | 0.05 |
| Appearance | | | OBSERVATION | CLEAR | | |
| ASTM Color | | | ASTM D1500 | | 1.0 | |
| Copper Corrosion | 3 h, 100° C. | | ASTM D130 | | 1B | |
| Density | 20° C. | kg/L | ASTM D1298 | | | 0.848 |
| Flash Point, COC | | ° C. | ASTM D92 | 160 | | 162 |
| Pour Point | | ° C. | ASTM D97 | | −3 | |
| Kinematic Viscosity | 40° C. | $mm^2/s$ | ASTM D445 | 8.3 | 10.9 | 9.8 |
| Kinematic Viscosity | 100° C. | $mm^2/s$ | ASTM D445 | | | 2.60 |
| Viscosity Index | | | ASTM D2270 | 90 | | 93 |

Chevron™ 220R refers to a base oil with the properties of Table 4.

TABLE 4

| Specification Test | Parameter | Unit of Measure | Test Method | Min | Max | Typical |
|---|---|---|---|---|---|---|
| Appearance, Odor and Texture | | | OBSERVATION | | | |
| Appearance | | | OBSERVATION | Clear & Bright | | |
| API Gravity | | °API | ASTM D287 | | | 31.9 |
| Density | 15° C. | kg/L | ASTM D1298 | | | 0.8655 |
| Flash Point, COC | | ° C. | ASTM D92 | 212 | | 230 |
| Kinematic Viscosity | 40° C. | $mm^2/s$ | ASTM D445 | 40.00 | 46.00 | 43.7 |
| Kinematic Viscosity | 100° C. | $mm^2/s$ | ASTM D445 | Report | | 6.60 |
| Apparent Viscosity, CCS | −20° C. | cP | ASTM D5293 | | 3600 | 3400 |
| Viscosity Index | | | ASTM D2270 | 95 | | 102 |
| Sulfur | | mg/kg | ASTM D7039 | | | <10 |
| ASTM Color | | | ASTM D1500 | | 1.5 | L0.5 |
| Pour Point | | ° C. | ASTM D97 | | −12 | −13 |
| Water Content | | mg/kg | ASTM D6304 | Report | | |
| Noack Evaporation Loss, Proc B | 1 h, 250° C. | mass % | ASTM D5800 | | 12 | 10 |
| Density | 60° F. | lb/gal | ASTM D1298 | Report | | 7.216 |

EXAMPLES

The following examples are provided to demonstrate particular embodiments of the present invention. It should be appreciated by those of skill in the art that the methods disclosed in the examples which follow merely represent exemplary embodiments of the present invention. However, those of skill in the art should, in light of the present disclosure, appreciate that many changes can be made in the specific embodiments described and still obtain a like or similar result without departing from the spirit and scope of the present invention.

Example 1

In the first round of testing, the original formulation was tested for KV100 (ASTM D445), KV40 (ASTM D445), Viscosity Index (ASTM D2270), CCS at −25 C (ASTM D5293), Pour Point (ASTM D97), MRV at −30 C (ASTM D4684). Additional formulations were tested with modifications in only the % PPD. Table 5 shows the formulations and test results.

TABLE 5

| Components/ Test Results | Original Formulation | Modified Formulation 1 | Modified Formulation 2 | Modified Formulation 3 | Modified Formulation 4 | Modified Formulation 5 |
|---|---|---|---|---|---|---|
| Parafinic Light Neutral (wt %) | 73.436 | 73.586 | 73.386 | 73.336 | 73.286 | 73.236 |
| Parafinic Spindle Oil (wt %) | 8.786 | 8.936 | 8.736 | 8.686 | 8.636 | 8.586 |

TABLE 5-continued

| Components/ Test Results | Original Formulation | Modified Formulation 1 | Modified Formulation 2 | Modified Formulation 3 | Modified Formulation 4 | Modified Formulation 5 |
|---|---|---|---|---|---|---|
| Detergent/ Dispersant Package (wt %) | 10 | 10 | 10 | 10 | 10 | 10 |
| Viscosity Modifier (wt %) | 6.028 | 6.028 | 6.028 | 6.028 | 6.028 | 6.028 |
| Friction Reducing Compound (wt %) | 1.435 | 1.435 | 1.435 | 1.435 | 1.435 | 1.435 |
| Demulsifier (wt %) | 0.005 | 0.005 | 0.005 | 0.005 | 0.005 | 0.005 |
| Foam Inhibitor (wt %) | 0.01 | 0.01 | 0.01 | 0.01 | 0.01 | 0.01 |
| PPD (wt %) | 0.3 | 0 | 0.4 | 0.5 | 0.6 | 0.7 |
| KV 100 (cSt) | 9.95 | 9.8 | 10 | 10.06 | 10.07 | 10.17 |
| KV 40 (cSt) | 61.93 | 60.8 | 62.6 | 62.68 | 63.14 | 63.09 |
| VI | 146 | 146 | 145 | 147 | 145 | 146 |
| CCS (cP) | 6440 | 6056 | 6474 | 6561 | 6597 | 6689 |
| Pour Point (° C.) | −36 | −9 | −36 | −36 | −39 | −36 |
| MRV Vis at −30° C. (cP) | 66101 | 5292994 | 64713 | 64849 | 69950 | 66555 |
| MRV Yield Stress at −30° C. (Pa) | 70 | >350 | 70 | 70 | 70 | 70 |

Example 2

In the second set of testing, the original formulation was tested again for Scanning Brookfield (ASTM D5133), Mini Rotory Viscometer (ASTM 5133), and the pour point. Two additional formulations were tested with the base oil ratios adjusted to contain 20% Group II oils. A fourth formulation was created with 20 wt % Group II oils and no PPD as shown below in Table 6.

TABLE 6

| Component Name | ENG09348 | | ENG09363 | | ENG09364 | | ENG09418 |
|---|---|---|---|---|---|---|---|
| Chevron ™ 220R (wt %) | 0 | | 20 | | 0 | | 20 |
| Motiva ™ Star 6 (wt %) | 0 | | 0 | | 20 | | 0 |
| (PETROBRAS ™) Paraffinic Light Neutral (wt %) | 73.4 | | 49.2 | | 49.2 | | 49.2 |
| (PETROBRAS ™) Paraffinic Spindle (wt %) | 8.8 | | 13.0 | | 13.0 | | 13.0 |
| Detergent/ Dispersant (wt %) | 10 | | 10 | | 10 | | 10 |
| Non-dispersant Viscosity Modifier (wt %) | 6.028 | | 6.028 | | 6.028 | | 6.028 |
| Friction Reducing Compound (wt %) | 1.435 | | 1.435 | | 1.435 | | 1.435 |
| Pour Point Depressant (wt %) | 0.3 | | 0.3 | | 0.3 | | 0 |
| Demulsifier | 0.005 | | 0.005 | | 0.005 | | 0.005 |
| Foam inhibitor (wt %) | 0 | | 0 | | 0 | | 0 |
| Gelation Index | 11 | 10.7 | 8.3 | 7.1 | 7.3 | 6.9 | N/A |
| Gel Index Temp (° C.) | −6.9 | −6.9 | −6.9 | −7.4 | −8.1 | −10.8 | N/A |
| Scanning Brookfield Vis at −30° C. (cP) | 47,623.0 | 47,513 | 42,208 | 42,243 | 47,374 | 43,330 | N/A |
| MRV Yield Stress at −30° C. (Pa) | 105 | 315 | NYS | NYS | NYS | NYS | 315 |

TABLE 6-continued

| Component Name | ENG09348 | | ENG09363 | | ENG09364 | | ENG09418 |
|---|---|---|---|---|---|---|---|
| MRV Vis at −30° C. (cP) | 51,838 | 53,372 | 40,089 | 39,790 | 40,344 | 47,876 | >60,000 |
| Pour Point, (° C.) | −38 | −41 | −43 | −42 | −44 | −43 | −11 |

NYS is defined as "no yield stress".
N/A is defined as "not available".

The results in Tables 5 and 6 indicate the following: The cold flow properties for formulations with Group II base oil were better than the original formulation without Group II base oil. Most noticeably, addition of Group II base oil to the original formulation eliminated the yield stress without the need for additional PPD. Although addition of Group II did not eliminate the need for some PPD, addition of Group II to a formula with some PPD proved to be a robust solution for eliminating MRV yield stress.

Also, addition of Group II base oil lowered the MRV Viscosity at −30 C and slightly lowered the pour point. So, in addition to eliminating MRV yield stress, addition of Group II can help a formulation more reliably meet MRV viscosity and pour point specifications.

Overall, there are a few possible reasons for the improvement in MRV. We theorize that Group II further breaks up the wax structure. Perhaps, it could cause the formation of additional wax structures that interfere with the existing wax structures. Alternatively, the PPD could be more compatible in both a Group I and Group II solution.

All patents, patent applications and publications are herein incorporated by reference to the same extent as if each individual patent, patent application or publication was specifically and individually indicated to be incorporated by reference.

The present invention if not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims.

What is claimed is:

1. A process for improving MRV performance and decreasing wax crystallization in a lubricating oil comprising:

a) obtaining a first base oil comprising:

at least about 55 wt % of molecules having paraffinic functionality, at least about 25 wt % of molecules having cycloparaffinic functionality, a ratio of weight percent molecules with paraffinic functionality to weight percent of molecules with cycloparaffinic functionality of about 2, a boiling range between about 359 to 490° C., a VI between about 96 to 106, a flash point between about 190 to 228° C., a kinematic viscosity between about 3.0 to 7.0 cSt at 100° C., and a kinematic viscosity between about 24 to 34 cSt at 40° C.; and b) blending a second base oil comprising a Group II base oil with the first base oil obtained in Step (a) to provide a base oil blend comprising from about 5 to about 60 wt % of the second base oil, wherein the first base oil is a Group I base oil.

2. The process of claim 1, wherein MRV performance is improved and wax crystallization is decreased in a lubricating oil by blending with the second base oil comprising a Group II base oil with no additional pour point depressant added.

3. The process of claim 1, wherein the second base oil, comprises:

hydrocarbons with consecutive numbers of carbon atoms, a boiling range between about 370 to 530° C., a VI between about 90 to 110, a Noack volatility between about 6.0 to 16 wt %, a kinematic viscosity between about 4.0 to 9.0 cSt at 100° C., a kinematic viscosity between about 36 to 50 cSt at 40° C., a flash point between about 202 to 240° C., total aromatics of less than 1 wt %, a CCS VIS at −20° C. between about 3200 to 3800 cP, and a pour point between about −8 to −17° C.

4. The process of claim 1, wherein the second base oil, comprises:

a boiling range between about 355 to 553° C., a VI between about 90 to 105, a Noack volatility between about 7.0 to 17 wt %, a kinematic viscosity between about 4.0 to 8.0 cSt at 100° C., a kinematic viscosity between about 35 to 51 cSt at 40° C., a flash point between about 206 to 235° C., total aromatics of less than 2.5 wt %, a CCS VIS at −20° C. of between about 2900 to 4200 cP, and a pour point between about −9 to −18° C.

5. The process according to claim 3 or 4, further comprising:

obtaining a third base oil, comprising:

a VI between about 85 to 98, a kinematic viscosity between about 1.0 to 4.0 cSt at 100° C., a kinematic viscosity between about 6.0 to 14 cSt at 40° C., a flash point between about 150 to 172° C., and a pour point between about 0° C. to −6° C.; and blending the third base oil with the first base oil and the second base oil to provide a base oil blend comprising from about 5 to about 60 wt % of the second base oil.

6. The process according to claim 5, further comprising adding an additive package to the base oil blend.

7. The process of claim 3, wherein the first base oil is Petrobras™ Paraffinic Light Neutral 30 and the second base oil is Chevron™ 220R.

8. The process of claim 4, wherein the first base oil is Petrobras™ Paraffinic Light Neutral 30 and the second base oil is Motiva™ Star 6.

9. The process of claim 5, wherein the third base oil is Petrobras™ Paraffinic Spindle 09.

10. The process of claim 3, wherein the first base oil obtained in Step (a) comprises: at least about 60 wt % of the molecules have paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.; and further comprising blending a third base oil with the first base oil obtained in Step (a) to provide a first base oil blend, wherein the third base oil comprises: a VI between about 88 to 95, a kinematic viscosity between about 2.0 to 3.0 cSt at 100° C., a flash point between about 158 to 164° C., and a pour point between about −1 to −4° C.; and blending the second base oil with the first base oil blend, wherein the second base oil, comprises: a VI between about 100 to 104, a Noack volatility between about 8.0 to 13 wt %, a kinematic viscosity between about 5.0 to 8.0 cSt at 100° C., a kinematic viscosity between about 39 to 47 cSt at 40° C., a flash point of about 208 to 234° C., total aromatics of less than 0.8 wt %, a CCS VIS at −20° C. between about 3300 to 3700 cP, and a pour point between about −11 to −14° C., and wherein the lubricating oil comprises about 49.2 wt % of the first base oil and about 20 wt % of the second base oil and about 13 wt % of the third base oil.

11. The process of claim 4, wherein the first base oil obtained in Step (a) comprises: at least about 60 wt % of the molecules have paraffinic functionality, at least about 28 wt % of the molecules have cycloparaffinic functionality, a VI between about 99 to 103, a flash point between about 198 to 220° C., a kinematic viscosity between about 4.0 to 6.0 cSt at 100° C., and a kinematic viscosity between about 26 to 32 cSt at 40° C.; and further comprising blending a third base oil with the first base oil obtained in Step (a) to provide a first base oil blend, wherein the third base oil comprises: a VI between about 88 to 95, a kinematic viscosity between about 2.0 to 3.0 cSt at 100° C., a flash point between about 158 to 164° C., and a pour point between about −1 to −4° C.; and blending the second base oil with the first base oil blend, wherein the second base oil, comprises: a VI between about 94 to 102, a Noack volatility between about 10 to 14 wt %, a kinematic viscosity between about 5.5 to 7.5 cSt at 100° C., a kinematic viscosity between about 39 to 47 cSt at 40° C., a flash point between about 211 to 229° C., total aromatics of less than 2 wt %, a CCS VIS at −20° C. between about 3100 to 3900 cP, and a pour point between about −11 to −16° C., and wherein the lubricating oil comprises about 49.2 wt % of the first base oil and about 20 wt % of the second base oil and about 13 wt % of the third base oil.

12. The process according to claim 10 or 11, further comprising adding an additive package to the blend of the first base oil, second base oil, and third base oil, wherein the additive package comprises:

a) between about 5 to 15 wt % of a detergent and dispersant;

b) between about 3 to 9 wt % of a non-dispersant viscosity modifier;

c) between about 0.5 to 2 wt % of a friction reducing compound;

d) between about zero to 0.5 wt % of a pour point depressant; and e) between about 0.001 to 0.008 wt % of a demulsifier.

13. The process of claim 1, wherein the lubricating oil is a multigrade engine oil meeting the specifications for SAE viscosity grade 0W-XX, 5W-X, or 10W-XX engine oil, wherein XX represents the integer 20, 30, or 40.

14. The process according to claim 1, 10 or 11, wherein the lubricating oil is a multigrade engine oil having:

a) a MRV at −30° C. of less than 50,000 and no yield stress;

b) a Noack volatility of less than about 15 wt %;

c) a Scanning Brookfield Viscosity between about 40,000 to 50,000 cP; and d) a Pour Point between about −39 to −46° C.

15. The process according to claim 14, wherein the lubricating oil is a multigrade engine oil having a Noack volatility of less than about 10 wt %.

* * * * *